US010197303B2

(12) United States Patent
Peticca

(10) Patent No.: US 10,197,303 B2
(45) Date of Patent: Feb. 5, 2019

(54) AIR REGISTER DRAIN

(71) Applicant: Danny Peticca, Gormley (CA)

(72) Inventor: Danny Peticca, Gormley (CA)

( * ) Notice: Subject to any disclaimer, the term of this patent is extended or adjusted under 35 U.S.C. 154(b) by 178 days.

(21) Appl. No.: 14/756,010

(22) Filed: Jul. 20, 2015

(65) Prior Publication Data

US 2017/0023274 A1 Jan. 26, 2017

(51) Int. Cl.
*F24F 13/22* (2006.01)

(52) U.S. Cl.
CPC ..... *F24F 13/222* (2013.01)

(58) Field of Classification Search
CPC ..... F24F 13/222; F24F 13/0227
USPC ..... 454/291; 285/235
See application file for complete search history.

(56) References Cited

U.S. PATENT DOCUMENTS 1,150,746 A 8/1915 Darroch
2,681,609 A * 6/1954 Drager ..... F24F 6/04 261/98
2,790,374 A * 4/1957 Powers ..... F24F 6/04 126/113
4,373,544 A * 2/1983 Goodman ..... F04D 27/0215 137/220
5,180,331 A 1/1993 Daw
5,297,992 A 3/1994 Bailey
6,835,129 B1 * 12/2004 Harris ..... F24F 13/082 454/289
2009/0064698 A1 * 3/2009 Spanger ..... F24F 13/222 62/280
2012/0267863 A1 * 10/2012 Kiest, Jr. ..... F16L 55/179 277/607
2013/0180204 A1 * 7/2013 Metz ..... F24F 13/084 3/84
2014/0011439 A1 1/2014 Young
2016/0325981 A1 * 11/2016 Diaz ..... B67D 3/0077

* cited by examiner

*Primary Examiner* — Steven B McAllister
*Assistant Examiner* — Allen Schult

(57) ABSTRACT

An air register drain, for draining liquid from a duct register opening, and having; a collector portion having a bottom wall, side walls, and a top wall and an end wall at one end; a duct connection (opening); an air register opening in the top; fastenings for fastening drain, the air register opening in position beneath a register opening in a floor, a liquid collection well wherein liquid can collect, and, a liquid drain in the well connectable to a liquid drain pipe.

4 Claims, 4 Drawing Sheets

AIR REGISTER DRAIN

FIELD OF THE INVENTION

The invention relates to a liquid drain for air handling ducts for use in HVAC systems, and in particular to ducts having registers which are liable to receive spilled liquids.

BACKGROUND OF THE INVENTION

Air duct systems, particularly in domestic residences, often provide air registers at floor level. Usually floor registers are installed where ducts run between floor joists in a multi-story building. The register may either be a supply or a return, although supply registers are more common. Where the register is in the floor, and if there is any liquid spilled on to the floor, it can flow through the register into the air duct system. Some liquid may flow around the register and simply collect on the ceiling of the room below. This problem occurs in an acute form where for example a bathroom or a laundry room is installed with floor registers. In such rooms, where the likelihood of liquids being spilled is more common, any liquid which flows down through a floor register opening will usually escape from the duct work and may damage the ceiling of the room beneath. Simply repairing the ceiling is not a solution. The problem may occur repeatedly.

Clearly it is desirable to provide a liquid drain, which can be secured beneath the floor, around the opening for the floor register. It is however apparent that any such liquid drain must also accommodate air handling facilities, to permit air to pass through the register either from, or back into the HVAC duct system.

BRIEF SUMMARY OF THE INVENTION

With a view to providing a solution to these problems, the invention provides an air register drain, defining a duct portion and a collection portion, wherein the duct portion can be connected to the duct work and wherein the collection portion serves to collect liquid leaking through the register.

Preferably the duct portion is defined by a duct bottom wall, duct side walls and a duct top wall. At one end of the duct portion, a duct connector is preferably provided, although this may be available as a separate accessory for connecting the duct portion of the air register drain to the duct work.

The collection portion is defined by a collector bottom wall, and collector side walls, and a collector end wall. An angled transition wall extends from the collector bottom wall to the duct bottom wall.

The collector bottom wall has a liquid drain connector, for connecting to any suitable liquid drain system in the building.

Preferably the invention will also provide a resilient liquid liner to prevent liquid flow around the register.

Preferably the invention provides a drain pipe trap connected to said liquid drain, whereby liquid can pass from said liquid well into said drain trap.

The drain trap may comprise a simple U-bend pipe, or may be in the form of a resilient one way flow valve, permitting liquid flow, but resisting reverse flow of drain gasses.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
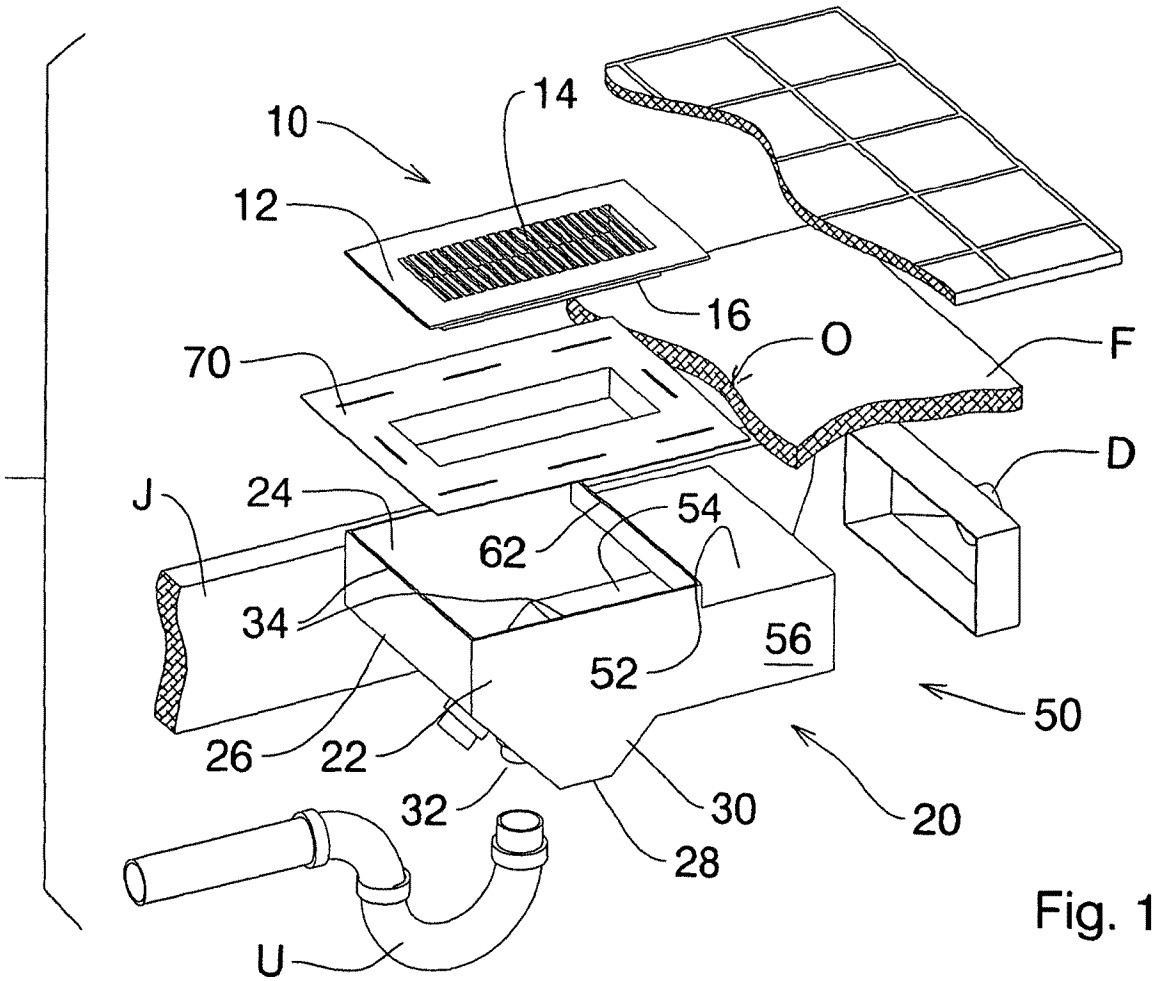
FIG. 1 is a perspective illustration of an air duct drain illustrating the invention with portions of the building structure cut away.

Referring first of all to FIG. 1, it will be seen that this shows an air duct drain illustrating the invention. For the purposes of the illustration some portions of the building structure have been shown cut away and without any limitation as to such structure.

The building structure in this illustration comprises a plurality of joists (J), typically supporting a floor indicated generally as (F). In such forms of construction, HVAC facilities such as the floor duct (D) are located, between adjacent joists, and between the underneath of the floor and upper surface of the ceiling of the space below. Air registers are located in suitable openings (0) in the floor (F).

The air register (10) will be seen to comprise a rectangular face plate (12) and a plurality of transverse guide blades (14). Such registers usually include a rectangular downwardly dependent flange wall (16), which fits down through the opening (O) in the floor (F). The register can be fastened in position, although usually it is simply placed in the opening (O) without any fastening. This permits the homeowner to lift the register occasionally, and vacuum the HVAC duct work beneath, if desired. As is well known, in conventional HVAC systems, duct (D) is connected to the floor opening (O) and the register (10) by means of a right angle connection known as a "boot".

In the present case however the conventional boot is missing.

In the present invention, in order to provide both air handling and also a liquid drain, the invention provides an air duct drain (20).

Drain (20) has a collector portion defined by planar vertical sidewalls (22) and (24), and end wall (26) and a bottom wall center planar portion (28) and rearward bottom wall angled sloping portion (30) and forward bottom wall sloping portion (32). Forward sloping bottom wall portion (32) connects between the bottom wall center planar portion (28), and end wall (26). Planar vertical side walls (22) and (24) of the of the collector portion are downward extensions in order to accommodate the shape and profile of the planar center bottom wall portion (28) and the angled sloping portions (30) and (32). The end wall (26) of the collector portion and the sidewalls (22) and (24), define top edges (34) which are all located in a common plane.

In this way, the collector portion of drain (20) provides a well. Any liquid which passes through the floor opening (O), or down through the register (10) itself, will collect in the well, and will not flow upwardly towards the duct (D).

A liquid drain pipe connection (40) is provided in the planar center bottom wall (28). The pipe connection (40) can be connected to any available plumbing drain system (not shown) in the building.

The drain also has a duct connection (50). Duct connection (50) has a top wall (52) and a duct bottom wall (54) and duct side walls (56) The duct side walls (56) in this embodiment are simply extensions of the side walls (22) and (24) of the collector portion.

The duct bottom wall (54), together with duct side walls (56) and duct top wall (52) form an air flow duct. In the case shown, the side walls are lying in planes which are parallel to one another, and the top wall and the bottom wall also lie in planes which are parallel to one another. The ends of the top wall, the side walls, and the bottom wall define an opening, which is adapted to be connected to an air duct connector (60) of known design. In this way the drain (20) can be readily adapted in air duct system, such as is particularly in use in domestic dwellings.

The bottom wall (28) of the well of the collector portion lies in a plane which is lower than the plane of the duct bottom wall (54) of the duct portion. The inclined sloping wall (30) and inclined sloping wall (32) joining the center planar bottom wall (28) of the duct portion ensure that liquid which falls into the well cannot escape and flow along the duct. portion (50).

Duct top wall (52) has an upturned flange (62). The flange (62) connects with the upper portions of side walls (22) and (24) of the collector portion. This defines, in this embodiment, a generally square outline. It will be dimensioned to fit within standard joist spacings found in construction specifications.

The upper edge of flange (62) terminates in the same plane as the top edges of side walls (22) and (24) and end wall (26). This plane is located slightly above the plane of the duct top wall (52). In this way, it is possible for the installers to ensure that the square outline of the drain is secured firmly underneath the floor so as to catch any liquid which may be spilled.

In this way it is possible for a standard air register (10) to be placed either length wise, parallel to the joists, or cross wise, transverse to the joists.

It will of course be appreciated that the design and shaping of the drain (20) may be adapted for use with different materials. Synthetic plastic is particularly suitable, since it will not become rusted by contact with liquids. However, sheet metal suitably galvanized or rust proof coated with any suitable coating, could also be used. The shaping of the well itself, which in this case, is of rectangular plan, could be varied so that it is simply a concave shape, somewhat like a sink, with a drain at the lowest point.

Any suitable support (not shown) can be provided and secured either to the joists (J) or the underside of the floor (F).

This way, the upper edges of the side walls (22), (24) and the end wall (26), and the upturned flange (62) of the duct top wall (52) are held snugly and firmly against the underside of the floor, fitting around the opening (O).

The air register (10) itself will be simply placed in the opening (O) in the floor in the usual way.

In the present case however in order to provide security against any possible liquid spilled on the floor, a resilient liner (70) is provided. The liner consists essentially of a piece of resilient material, defining a rectangular shape with an opening, and edge flanges which will permit the register (10) to be fitted down through the opening (O) in the floor.

The liner is placed on the sub floor, which is usually plywood sheeting.

The floor surface, such as tile or vinyl sheet in many cases, will be laid over the liner.

The rectangular face plate of the air register (10) will lie smoothly on the surface of the floor.

Thus when the air register (10) is placed in position, with its face plate lying on the floor around the opening, any liquid which is spilled on the floor will flow over the face plate of the register (10) and down through the register itself. Such liquid will then collect in the well of the drain. From the well portion such liquid will flow down through the drain pipe into the plumbing drains of the building.

If any liquid should pass under the face of the register, the liner will catch it and ensure that it flows down into the drain. The liner will prevent liquid from flowing between the tiles and the wood sub floor, which would otherwise cause a problem.

Figure 5:
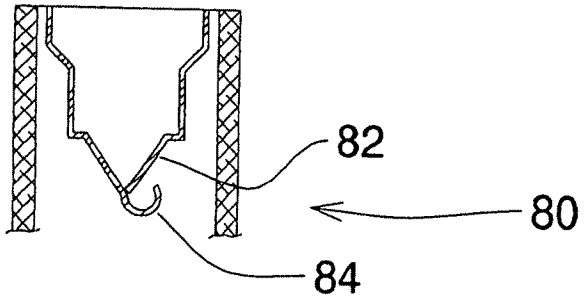
FIG. 5 is a section of an alternate form of drain valve.

Since the pipe will be connected to the plumbing drain, the usual precautions must be taken to prevent return flow of drain gases. Thus the pipe may be formed into a conventional U-bend (U). However in many cases, since the flow of liquid may only take place occasionally the liquid in the U-bend may itself either become contaminated, or simply evaporate. Thus in many cases it may be preferable to provide a return flow preventer valve (80) (FIG. 5). Such return flow preventer valve as is well known consists of a flexible rubber or plastic or synthetic sleeve (82), formed with flexible lower edges (84) which are pinched closed. If liquid is present the sleeve (82) will open momentarily to permit flow. Debris or dust may fall through the register from time to time. To ensure that the pipe does not become blocked with debris or dust, a typical drain screen (84) is placed at the bottom of the drain over the pipe connection (40).

The pipe connections will all be provided with "knock out" covers (98), one of which will be removed, when a drain pipe is connected.

Figure 3:
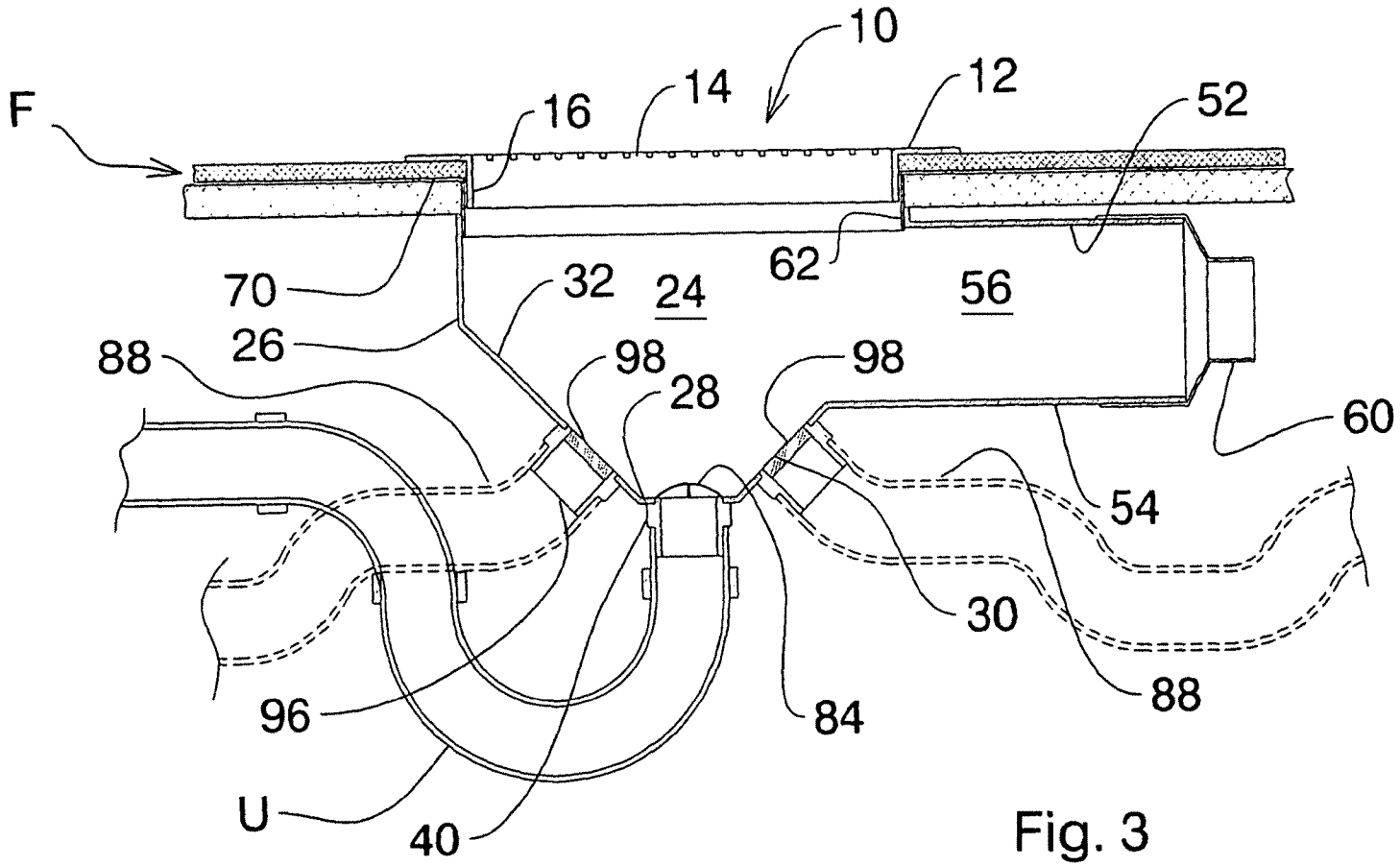
FIG. 3 is a section along 3-3 of FIG. 2.

Also shown in FIG. 3, in phantom, is a method of connecting a drain pipe at an angle to the angled drain outlet in the forward sloping angled bottom end wall (32).

Figure 2:
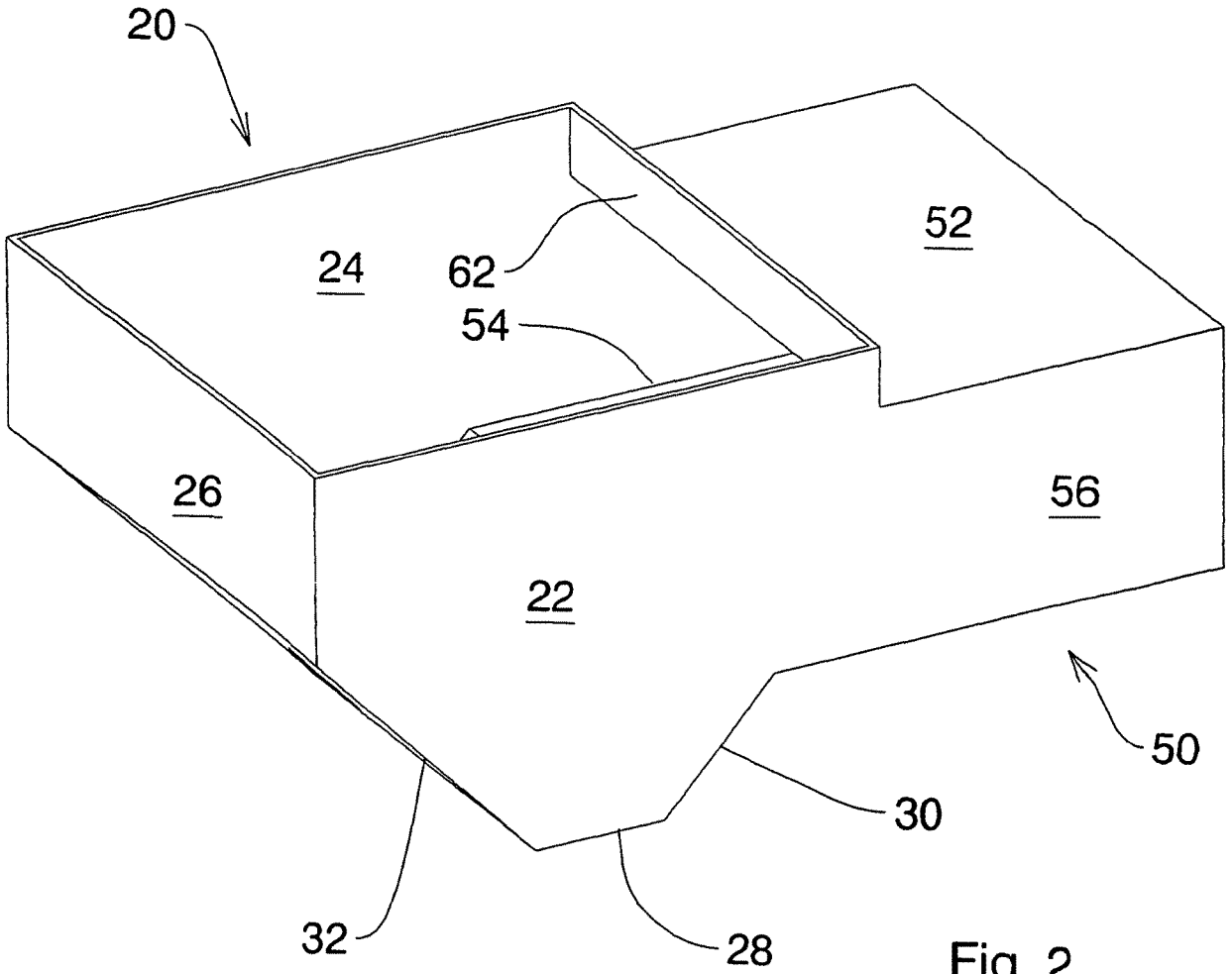
FIG. 2 is an exploded perspective of the air duct drain in FIG. 1.
Figure 4:
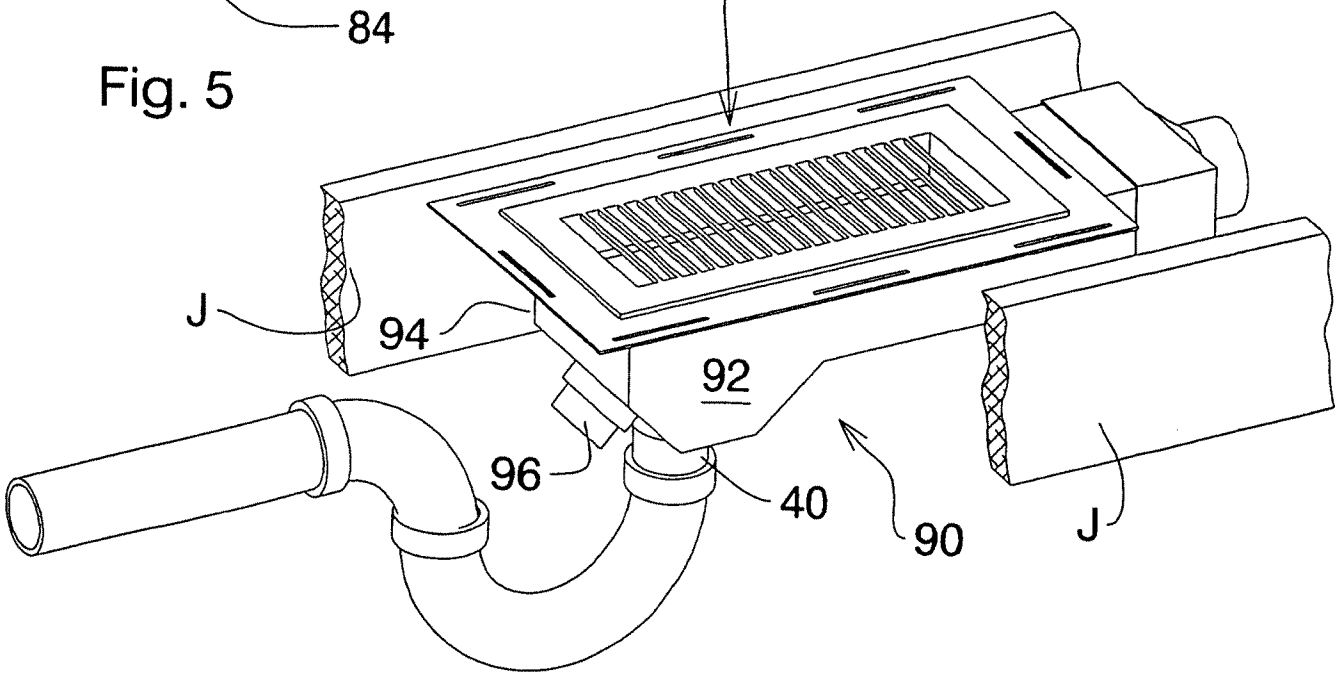
FIG. 4 shows an alternate form of drain for restricted spaces.

In this case it would be connected to the side forward drain pipe connection (96), located in the angled forward sloping bottom wall portion (32) and the U bend (or trap) could be located a distance away from the collector There will be cases in construction where the joists are placed closer together than standard spacings. In these cases, it will not be possible to use a square configuration for the collector portion. A modified form of drain (90), as shown in FIG. 4 will be provided in these cases. This has all of the basic features of the drain (20) of FIGS. 1, 2 and 3, with the exception that the side walls (92) and (94) are closer together, and the duct portion is correspondingly narrower.

This will of course mean that the standard air register will have to be inserted parallel with the joists, since the joists will be too close together to permit the air register to lie transverse.

There will also be cases where the depth of the joists does not permit the use of a drain pipe with a conventional U-bend (U). For these cases, the angled drain outlet (96) is provided in the forward sloping wall (32) of the collector portion. An angled drain pipe (not shown) can then be connected to such angled drain outlet. There will also be cases where the depth of the joists does not permit the use of the center drain outlet in the bottom centre planar bottom and a central drain pipe connected to the center drain outlet with a conventional U-bend (U). In these cases, the angled drain outlet (96) provided in the collector portion, can then be connected to an angled drain pipe (not shown). In these cases the preventer valve of FIG. 5 will typically be used.

It will thus be apparent that once the air register drain has been fastened in position and once the seal has been placed in position around the floor opening and the floor register itself has been inserted in position, then any liquid which may be spilled on the floor will flow either around the register, or will flow through the register itself. In either case such liquid will collect in the liquid well formed by the drain (20) Such liquid will then pass through the liquid drain pipe, and into the drain systems of the building.

The register usually measures 4" by 10". By making the drain square, the installer can locate the drain opening, in the floor either lengthwise, or transverse.

The installer can locate the floor opening centrally of, or to one side or the other of the square drain, without requiring a special alignment of the drain with the floor opening.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A between floor air register drain system for draining liquid from a floor duct register located between a floor and a ceiling, comprising:

a collector portion having collector side walls spaced apart a predetermined distance, and a collector forward end wall at a forward end of said collector portion;

a duct portion having duct side walls and a duct top wall and a duct bottom wall at a rearward end of said collector portion remote from said collector forward end wall;

an air register opening defined by upper edges of said collector portion side walls and said collector portion end wall, and by an upturned wall formed on said top wall of said duct portion;

a liquid collection well below said collector portion wherein liquid can collect, wherein said liquid collection well has a center planar rectangular bottom wall portion having forward and rearward edges and side edges spaced apart by a width co-extensive with said distance that said collector side walls are spaced apart by;

a sloping inclined forward wall portion on said forward edge of said center planar rectangular bottom wall portion;

a sloping inclined rearward wall portion connected to said rearward edge of said center planar rectangular bottom wall portion and connected to said duct bottom wall;

separate spaced apart planar vertical side wall portions formed by downward extensions of said collector side walls and joined to respective side edges of said center planar rectangular bottom wall portion and joined to respective side edges of said sloping inclined forward wall portion and joined to respective side edges of said sloping inclined rearward wall portion;

a forward liquid drain opening in said sloping inclined forward wall portion connectable to a liquid drain pipe, wherein said duct bottom wall defines a first level, and wherein said liquid collection well center planar bottom wall defines a second level and wherein said second level is lower than said first level, preventing liquid in said liquid collection well from flowing into said duct portion; and a resilient liner having a rectangular opening with flanged edges, wherein the resilient liner is laid on top of a sub floor around the air register opening and the rectangular opening of the resilient liner is positioned to correspond with the air register opening, a floor surface is laid on top of the resilient liner, and the flanged edges of the rectangular opening are situated downwards within the air register opening perpendicularly to the resilient liner.

2. The between floor air register drain system of claim 1, wherein an air register is placed within the rectangular opening of the resilient liner such that the flanged edges of the resilient liner are positioned between the air register and air register opening.

3. A between floor air register drain system for draining liquid from a floor duct register located between a floor and a ceiling, comprising:

a collector portion having collector side walls spaced apart a predetermined distance, and a collector forward end wall at a forward end of said collector portion;

a duct portion having duct side walls and a duct top wall and a duct bottom wall at a rearward end of said collector portion remote from said collector forward end wall;

an air register opening defined by upper edges of said collector portion side walls and said collector portion end wall, and by an upturned wall formed on said top wall of said duct portion;

a liquid collection well below said collector portion wherein liquid can collect, wherein said liquid collection well has a center planar rectangular bottom wall portion having forward and rearward edges and side edges spaced apart by a width co-extensive with said distance that said collector side walls are spaced apart by;

a sloping inclined forward wall portion on said forward edge of said center planar rectangular bottom wall portion;

a sloping inclined rearward wall portion connected to said rearward edge of said center planar rectangular bottom wall portion and connected to said duct bottom wall;

separate spaced apart planar vertical side wall portions formed by downward extensions of said collector side walls and joined to respective side edges of said center planar rectangular bottom wall portion and joined to respective side edges of said sloping inclined forward wall portion and joined to respective side edges of said sloping inclined rearward wall portion;

a center liquid drain opening in said center planar rectangular bottom wall portion connectable to a liquid drain pipe, wherein said duct bottom wall defines a first level, and wherein said liquid collection well center planar bottom wall defines a second level and wherein said second level is lower than said first level, preventing liquid in said liquid collection well from flowing into said duct portion; and a resilient liner having a rectangular opening with flanged edges, wherein the resilient liner is laid on top of a sub floor around the air register opening and the rectangular opening of the resilient liner is positioned to correspond with the air register opening, a floor surface is laid on top of the resilient liner, and the flanged edges of the rectangular opening are situated downwards within the air register opening perpendicularly to the resilient liner.

4. The floor air register drain system of claim 3, wherein an air register is placed within the rectangular opening of the resilient liner such that the flanged edges of the resilient liner are positioned between the air register and air register opening.

* * * * *